US006637513B1

(12) United States Patent
van der Poel

(10) Patent No.: US 6,637,513 B1
(45) Date of Patent: Oct. 28, 2003

(54) RISER PIPE CONSTRUCTION AND MODULE THEREFOR

(75) Inventor: Hans van der Poel, Vlaardingen (NL)

(73) Assignees: Adviesbureau H. Van Der Poel, Vlaardingen (NL); Buitendijk Holding B.V., Zwigndrecht (NL)

( * ) Notice: Subject to any disclaimer, the term of this patent is extended or adjusted under 35 U.S.C. 154(b) by 0 days.

(21) Appl. No.: 09/622,242

(22) PCT Filed: Feb. 16, 1999

(86) PCT No.: PCT/NL99/00077

§ 371 (c)(1),
(2), (4) Date: Oct. 5, 2000

(87) PCT Pub. No.: WO99/41484

PCT Pub. Date: Aug. 19, 1999

(30) Foreign Application Priority Data

Feb. 16, 1998 (NL) ..... 1008311

(51) Int. Cl.[7] ..... E21B 33/037

(52) U.S. Cl. ..... 166/350; 166/367; 405/170; 405/171; 405/224; 405/224.2; 175/7; 114/243

(58) Field of Search ..... 405/223.1, 224, 405/224.2, 224.3, 224.4, 169–171; 166/350, 359, 367, 352, 345, 344, 342; 175/5–7; 114/243

(56) References Cited

U.S. PATENT DOCUMENTS

| | | | | |
|---|---|---|---|---|
| 2,988,144 A | * | 6/1961 | Conrad | 166/350 |
| 3,221,817 A | | 12/1965 | Vries et al. | |
| 3,330,340 A | | 7/1967 | Hayes et al. | |
| 3,354,951 A | | 11/1967 | Savage et al. | |
| 3,378,067 A | | 4/1968 | Leonard et al. | |
| 3,407,417 A | | 10/1968 | Garland | |
| 3,538,955 A | | 11/1970 | Anderson | |
| 3,855,656 A | | 12/1974 | Blenkarn | |
| 3,858,401 A | * | 1/1975 | Watkins | 405/224.2 |
| 3,933,108 A | | 1/1976 | Baugh | |
| 4,040,264 A | * | 8/1977 | Neilon | 405/224.2 |
| 4,063,602 A | * | 12/1977 | Howell et al. | 175/7 |
| 4,091,881 A | * | 5/1978 | Maus | 175/7 |
| 4,099,560 A | | 7/1978 | Fischer et al. | |
| 4,147,221 A | * | 4/1979 | Ilfrey et al. | 175/7 |
| 4,606,673 A | | 8/1986 | Daniell | |
| 4,646,840 A | * | 3/1987 | Bartholomew et al. | 166/350 |
| 6,155,748 A | * | 12/2000 | Allen et al. | 405/224 X |

FOREIGN PATENT DOCUMENTS

| | | | | |
|---|---|---|---|---|
| GB | 2133446 | * | 7/1984 | 405/210 |
| GB | 2307705 | | 6/1997 | |

* cited by examiner

*Primary Examiner*—Jong-Suk (James) Lee
(74) *Attorney, Agent, or Firm*—Weingarten, Schurgin, Gagnebin & Lebovici LLP

(57) ABSTRACT

A riser pipe construction for a drilling connection from a drilling vessel to a valve previously provided on a sea floor comprises a riser pipe through which drilling means can be passed by means of which an oil well can be drilled as well as pressure pipes extending along the riser pipe to operate the valve, and floating elements disposed around the riser pipe and the pressure pipes to limit the load on the drilling vessel. The riser pipe and the pressure pipes are built up from modules capable of being coupled together, the floating elements are formed by steel tubular chambers closed so as to be gastight, disposed around the relevant modules and firmly connected thereto. The invention also relates to a riser pipe module.

13 Claims, 4 Drawing Sheets

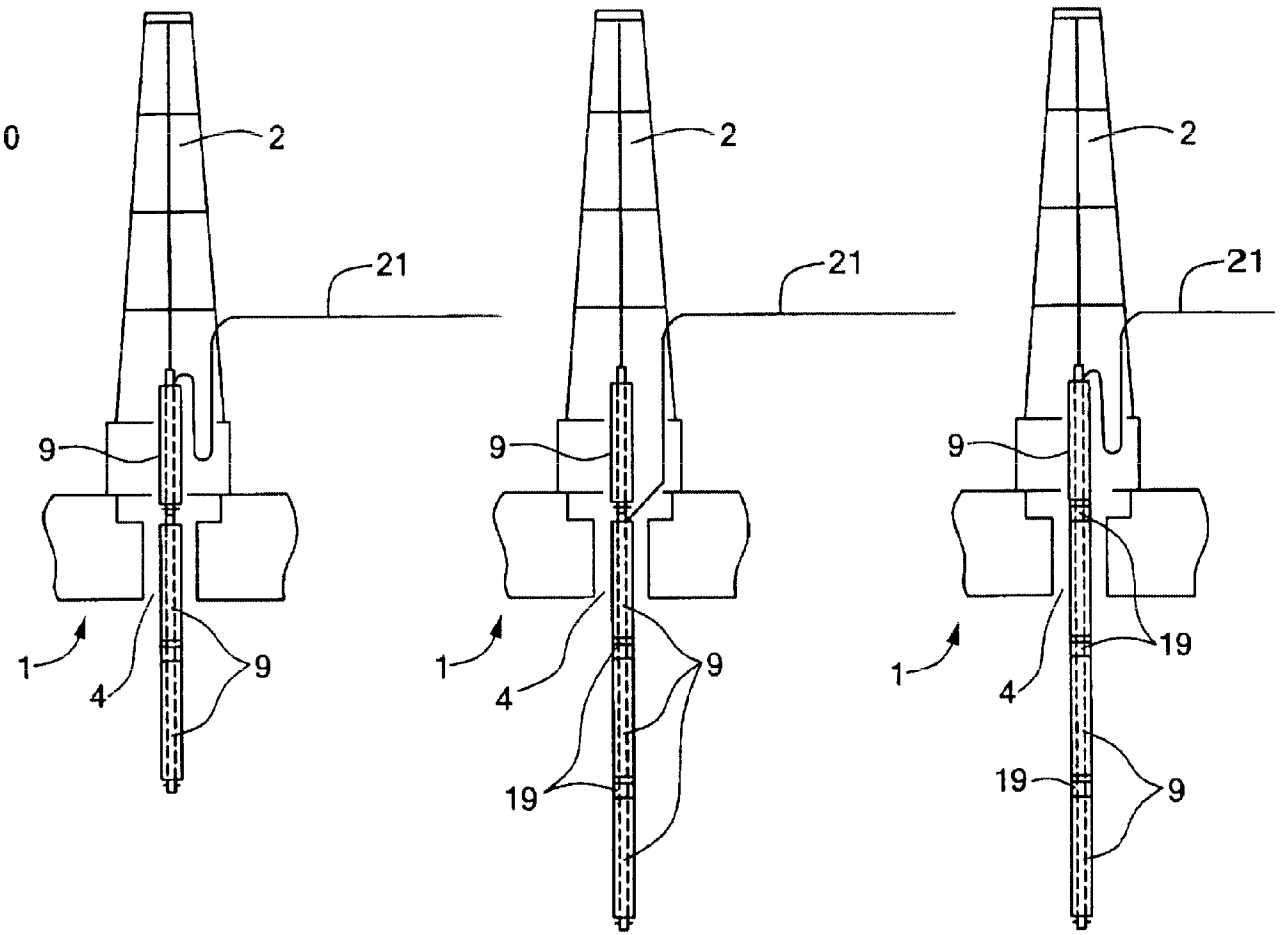
FIG. 4A
FIG. 4B
FIG. 4C
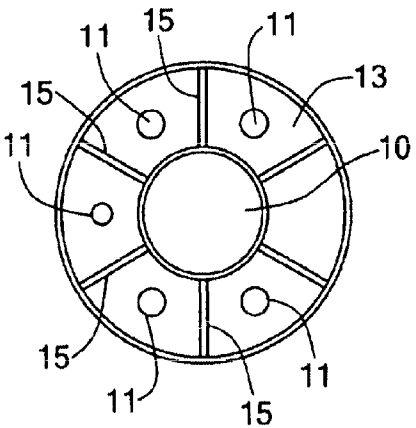
FIG. 3

RISER PIPE CONSTRUCTION AND MODULE THEREFOR

BACKGROUND OF THE INVENTION

The present invention relates to a riser pipe construction for a drilling connection from a drilling vessel to a valve previously provided on a sea floor, comprising a riser pipe through which drilling means can be passed by means of which an oil well can be drilled, as well as pressure pipes extending along the riser pipe to operate the valve, and floating elements disposed around the riser pipe and the pressure pipes to limit the load on the drilling vessel, the riser pipe and the pressure pipes being built up from modules capable of being coupled together, the floating element being formed by at least one steel tubular chamber closed so as to be gastight, disposed around a module and firmly connected thereto.

Such a riser pipe construction is known from e.g. U.S. Pat. No. 3,354,951 or U.S. Pat. No. 3,330,340. In the known construction, the chambers form a protection against possible damage to the pressure pipes and perhaps to the riser pipe during the lowering of the riser pipe into the sea from the drilling vessel, while the air in these chambers already imparts a certain floating power to the riser pipe.

U.S. Pat. No. 3,378,067 describes an under water well head with a buoy from which water can be expelled by means of high pressure gas in a capsule. With this buoy a connection head on the sea bottom can be raised or the location of the connection head can be marked.

U.S. Pat. No. 4,099,560 discloses a riser pipe construction having floating elements formed by open tubular members from which water can be expelled by releasing air from a pressurized container.

The known construction is used during the drilling of oil wells under the sea floor, after they have already been located during exploratory drillings and after a connecting body with a valve in the form of a "lower riser marine package (LRMP)" has been placed on the sea floor by means of a robot. From a drilling vessel, a riser pipe construction is passed down stepwise by mounting individual modules together in each step and lowering them into the sea from an opening at the bottom of the drilling vessel, and by means of a robot connected to the connecting body on the sea floor. Subsequently, the valve is opened by means of the pressure pipes and the drilling means are passed through the riser pipe to drill the oil well. These drilling means comprise a drill head and a narrower pipe passed through the riser pipe. Then the drilled oil well must be closed. However, as a result of the drilling of the oil well, gases and oil can be released and leak via the space between the narrower pipe and the riser pipe. This leaking occurs at pressures of from 200 to 300 bar, so that oil and gas may rise with tremendous force and constitute a danger on the drilling vessel. To prevent this, the riser pipe is filled with mud to apply a counter pressure slightly higher than the leaking gas/oil pressure.

After the oil well has been closed, the riser pipe construction may then be coupled off and moved up into the drilling vessel. The mud contained in the riser pipe is released into the sea. Although at a later time a drilling platform for the oil extraction may take the place of the drilling vessel, there is an increasing tendency to extract the oil from the drilling vessel, in which case an oil pipe must be passed through the riser pipe. In that case, however, the drilling vessel must be kept in place, which may be done by means of anchor cables or, if the sea is too deep, by using an engine.

In practice, a riser pipe is built up from steel pipe modules which often have a length of 75 feet (about 23 m) and an inner section of 19 inches (about 48 cm). In practice, the installation of such a riser pipe is attended by different problems. First, the water pressure constitutes a problem with relatively long riser pipe constructions. This problem particularly becomes apparent when the sea floor is at a depth of more than 2000 m. It must be realised that at present about 20% of the estimated world oil supply is exploited at a depth of less than 2000 m, while about 70% of this supply is at a depth of from about 2500 to 4000 m. To exploit this oil supply, because of the necessary large steel plate thickness which a riser pipe must have for this depth to resist the water pressure and, consequently, the heavy weight thereof, there must be built drilling vessels other than are in use at present. Consequently, to enable partial compensation of the weight of the riser pipe, there are already used floating elements disposed around the riser pipe and the pressure pipes. The known floating elements consist of plastic blocks, in particular of polystyrene, which are filled with air. However, the maximum water depth at which these floating elements can be used is about 2200 m. At greater depths, it turns out that these floating elements are pressed together or implode and air escapes therefrom, with the result that the floating power decreases and the compensation for the weight of the riser pipe becomes insufficient. An even heavier hoisting construction and an even larger design of the drilling vessel are then necessary. When a riser pipe is passed down stepwise from the opening at the bottom of the drilling vessel, the riser pipe, certainly when the first modules have been mounted, will be carried away by the water current. Then the riser pipe nearly always comes in contact with the bottom of the hull, which may easily damage the floating elements and the pressure pipes in particular. If damage has been caused to the floating elements, the floating power is further decreased with the attendant above-mentioned disadvantages. If damage has been caused to the pressure pipes, the whole riser pipe must be moved up again to enable repair. Negligence in this respect leads to an attack on the environment because oil may find its way from a pressure pipe into the sea. Moreover, the costs involved in such repairs are extremely high, particularly because repair of the riser pipe constructions that are in use at present must be carried out ashore, which also causes a lot of problems from an insurance standpoint.

SUMMARY OF THE INVENTION

It is an object of the invention to remove, at least substantially reduce, these disadvantages.

According to the invention, the riser pipe construction as defined in the opening paragraph is therefore characterized in that the tubular chamber is filled under elevated pressure with a medium.

By filling the chambers under elevated pressure with a medium, for instance air, in particular up to a pressure of the order of 100 bar, the load on the riser pipe and the floating elements decreases. At a depth of about 2000 m, a pressure of about 200 bar is exerted on the riser pipe construction. At a pressure of about 100 bar in the chambers of the floating elements, there results a pressure of 100 bar on the outer wall of the riser pipe construction. When during the drilling of the oil well gas and oil leak and the riser pipe is filled with mud at a pressure of the order of 300 bar, the pressure on the wall of the riser pipe is reduced by the pressure in the chambers of about 100 bar to about 200 bar. Through the construction according to the invention, it further becomes possible to carry out repairs on the drilling vessel itself, thus saving transport costs.

By providing the tubular chambers with partitions disposed substantially radially with respect to the riser pipe, they can be reinforced such that the plate thickness of the steel chambers can be reduced. This leads to a further decrease of the load on the drilling vessel.

When one of the tubular chambers becomes defective and lets in water, it is favorable if these partitions are so strong that they can take up the resulting pressure increase on the wall of the riser pipe. This means that there may be modules which need not by any means be provided with chambers disposed around the riser pipe. In that case, the floating power of the riser pipe construction decreases; the whole construction, however, is so dimensioned that a decrease of the floating power by about 10% is still acceptable. The invention therefore also relates to a riser pipe construction for a drilling connection from a drilling vessel to a valve previously provided on a sea floor, comprising a riser pipe through which drilling means can be passed by means of which an oil well can be drilled, as well as pressure pipes extending along the riser pipe to operate the valve, the riser pipe and the pressure pipes being built up from modules capable of being coupled together, characterized in that the riser pipe comprises substantially radially disposed partitions. Such a riser pipe may of course comprise floating elements which are disposed around the riser pipe to limit the load on the drilling vessel, and which are formed by at least one steel tubular chamber closed so as to be gastight, disposed around a module and firmly connected thereto.

As stated before, the riser pipe may be filled with mud to provide a counterpressure against leaking oil and gases from the connecting body. When the connecting body is closed again and the riser pipe must be moved up, this mud, which may perhaps be fully permeated by oil and gases, finds its way into the sea, which is an undesirable situation from an environmental standpoint. Hence, according to another aspect of the invention, the riser pipe comprises at least one opening closable by a valve, and capable of being put into communication with a relevant pipe extending upwards through the floating elements. Via this pipe, at least part of the mud can be sucked up before the riser pipe is moved up. Preferably, there are three of such pipes. To facilitate the moving up of the mud, this connection includes a pump placed within a chamber. Because the power of a pump, particularly because this pump must be placed in a chamber of limited space, cannot be chosen too high, it proves to be a right choice if the relevant opening is provided about halfway the total length of the riser pipe.

In a concrete embodiment according to the invention, the modules are provided at the ends with at least one flange part and can be coupled together through this flange part, while a tubular chamber extends along a module in the longitudinal direction to near the relevant flange part, on the one hand, and, on the other hand, the relevant connecting place at the flange part of a module to be coupled. To protect the coupling part of the modules, a covering element is preferably disposed between the tubular chambers around two modules coupled together. In particular, the tubular chambers have a cylindrical shape and the same diameter, while the covering element also has a cylindrical shape and the same diameter as the tubular chambers. Consequently, the riser pipe has, over its full length, a cylindrical shape with a fixed diameter, so that it can be lowered into the sea from the drilling vessel by means of guide rollers.

To further limit the weight of the riser pipe construction, special steel types may be used. Thus, for instance, it is possible that the tubular chambers are manufactured from steel having a plate thickness of the order of from 10 to 25 mm, preferably about 18 mm, and a yield strength of at least 800 N/mm$^2$, preferably about 1100 N/mm$^2$. Such a steel type is commercially available under the name of Weldox 1100 steel from the firm of SSAB of Oxelösund of Sweden. The tubular chambers and covering elements can easily resist a water pressure up to a depth of at least 3500 m, while yet the total weight of the riser pipe construction as such can be kept limited so as to enable working with the existing drilling vessels.

Each vessel can take a maximum of tonnage (payload), so that a light design is very important. If the drilling vessel cannot take in enough riser pipe construction parts, particularly for a greater depth, the further riser pipe construction parts must be conveyed by a separate transport vessel. Drilling more deeply generally means drilling at a greater distance from the coast and, consequently, higher transport costs. The above-mentioned measures taken to limit the load on the ship by means of a lighter design of the riser pipe construction therefore lead, particularly during the drilling at a greater depth and farther from the coast, to substantial savings in costs.

The invention also relates to module for a riser pipe construction.

BRIEF DESCRIPTION OF THE DRAWINGS

The invention will now be explained in more detail with reference to the accompanying drawings, in which

FIG. 3 is a cross-section of the construction part shown in FIG. 2;

FIGS. 4(A), 4(B) and 4(C) show three diagrams illustrating the manner of lowering a riser pipe construction according to the invention from a drilling vessel;

DESCRIPTION OF THE PREFERRED EMBODIMENT

Figure 1:
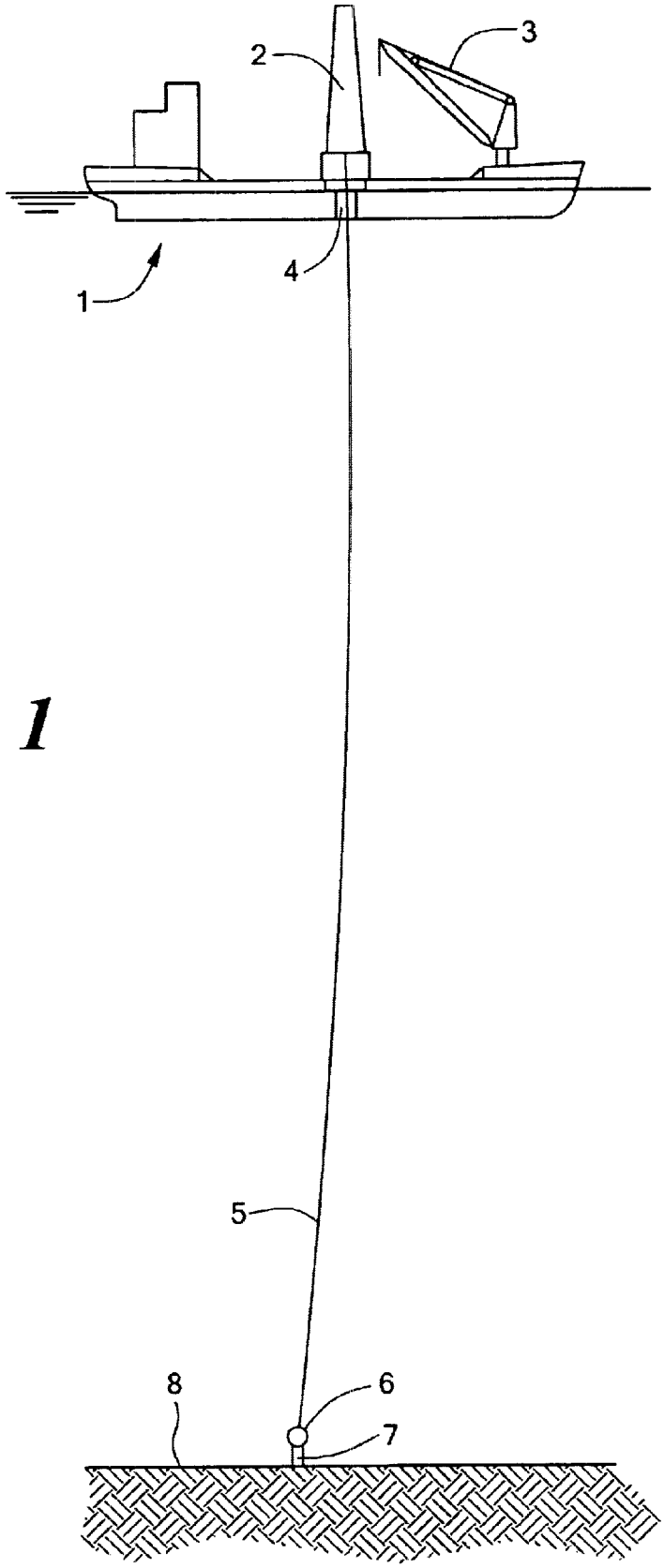
FIG. 1 is a diagrammatic representation of a riser pipe construction lowered from a drilling vessel and connected to a valve on the sea floor.
Figure 2:
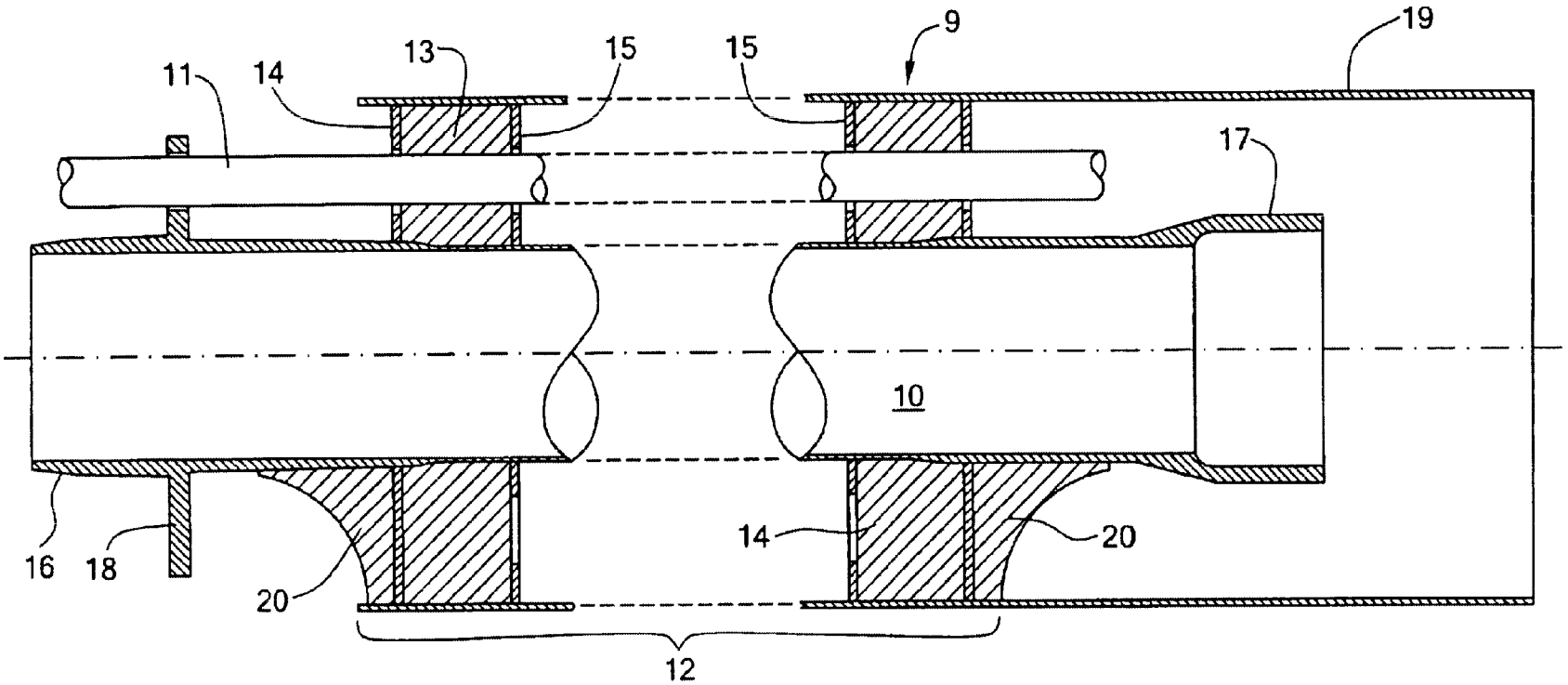
FIG. 2 is an interrupted longitudinal section of a part of this construction.

FIG. 1 shows a drilling vessel 1 comprising a drilling rig 2 and hoisting means 3. Through an opening 4 at the bottom of the drilling vessel 1 a steel riser pipe construction 5 is lowered from the drilling rig 2 into the sea and coupled in the known manner by means of a ball joint construction to the valve 6 on the connecting body 7, which is arranged on the sea floor 8. The riser pipe construction 5 is built up during the lowering by coupling construction parts 9 together. FIG. 2 shows an interrupted longitudinal section of such a construction part 9. This construction part comprises a riser pipe module 10 with pressure pipes 11 extending substantially parallel along the outside thereof, and consisting of hydraulic pipes and so-called "choke and kill" pipes. These pipes 11 are also built up from modules and have the same length as the riser pipe modules. Such pressure pipes, which are used, inter alia, to operate the valve 6, are known per se; their specific functions need not be explained herein in more detail because they do not form part of the present invention. Disposed around the riser pipe module 10 and the pressure pipes 11 is a floating element 12 in the form of a steel tubular chamber 13 enclosed so as to be gastight and firmly connected to the riser pipe module 10. At the top and the bottom, this chamber 13 is closed by plates 14 which are sealingly welded to the riser pipe module 10 and the pressure pipes 11. The chamber 13 comprises partitions 15 disposed substantially radially with respect to the riser pipe module 10 and preferably placed at mutual distances of about 60 cm. These partitions 15 enable a smaller plate thickness of the tubular casing of the chamber 13 than without these partitions, which is important in connection with the necessity to keep the total weight of the individual modules as low as possible, so that more modules can be coupled together and a greater depth can be reached with the riser pipe construction. To this also contributes the filling of the chamber 13 with a medium, in particular air, under elevated pressure. Besides the water pressure, this medium also provides a counter pressure when during the drilling of the oil well a higher gas pressure is built up in the riser pipe. A further measure to limit the weight of the riser pipe construction parts as much as possible lies in the selection of the material. In particular the chambers 13 of the different modules may be manufactured from steel having a plate thickness of the order of from 10 to 25 mm, in the present embodiment 18 mm, while the yield strength of the steel tubes used for the chambers 13 is at least 800 $N/mm^2$ and in the present embodiment, through the selection of Weldox 1100 steel from the firm of SSAB of Oxelösund in Sweden, 1100 $N/mm^2$. Such a steel type may of course also be used for the riser pipe modules themselves. In FIG. 2 the two ends of the riser pipe modules 10 are of such design that a slightly widened end 17 of a riser pipe module encloses a slightly tapering end 16 of a riser pipe module to be connected thereto, so that during the building up of the riser pipe the individual modules can be readily slid together and then fixed with respect to each other so as to be watertight. One or both ends 16, 17, in the present exemplary embodiment the end 16, is provided with a flange 18 on which the pressure pipe parts are fixed and connected together. The chambers 13 extend around the relevant riser pipe modules approximately to near the flange parts connected to the relevant modules, on the one hand, and, on the other hand, the relevant connecting places at the flange part of a module to be coupled to the relevant modules or, in other words, when the riser pipe modules are connected together, the chambers each extend from about one to the next flange part. To allow the chambers to connect to each other, a covering element 19 is disposed around the coupling part of two riser pipe modules. To give the whole riser pipe construction a continuous course, the different chambers 13 and covering elements 19 all have the same cylindrical shape and the same diameter. In practice, the covering element 19 will be built up from two semicylindrical parts which can be connected together over their length. The space enclosed by the covering element 19 and extending between the chambers 13 can be closed so as to be gastight, although this is not necessary. It is further observed that arched stiffening partitions 20 are disposed between the ends of the chambers and the riser pipe modules.

FIGS. 4(A), 4(B) and 4(C) show three diagrams illustrating the manner of lowering a riser pipe construction according to the invention from a drilling vessel.

FIG. 4(A) shows the situation in which, at the bottom of the drilling rig 2 and in the appropriate space in the drilling vessel 1, a third riser pipe construction part 9 is placed vertically above two riser pipe construction parts 9 previously lowered through the opening 4 into the sea. The riser pipe construction parts are brought into this position by means of hoisting means 3 and coupled together in the drilling vessel 1. Via a pipe 21, the chamber 13 of the last riser pipe construction part placed is filled with compressed air. The covering element 19 is also placed, after which the riser pipe construction formed until then can be lowered further into the sea, as shown in FIG. 4(B), and a next riser pipe construction part, in FIG. 4(B) a fourth part, can be coupled, after which, as shown in FIG. 4(C), the chamber of this last riser pipe construction part is filled with compressed air via the pipe 21, the covering element is placed again and the riser pipe construction is lowered into the sea further again. During the lowering, the riser pipe construction can be passed through guide rollers provided in the opening 4 and supported on the outer wall of the chambers and the covering element. This may prevent a riser pipe construction part from being carried away by the water current during the lowering and from being damaged through contact with the bottom of the hull.

The procedure described herein is continued until the lowermost riser pipe construction part has reached the sea floor and can be connected to the connecting body 7. The lower end of the riser pipe construction part to be lowered into the sea first is therefore, unlike the other riser pipe construction parts, provided with a specific connecting element having a ball joint construction.

Figure 5:
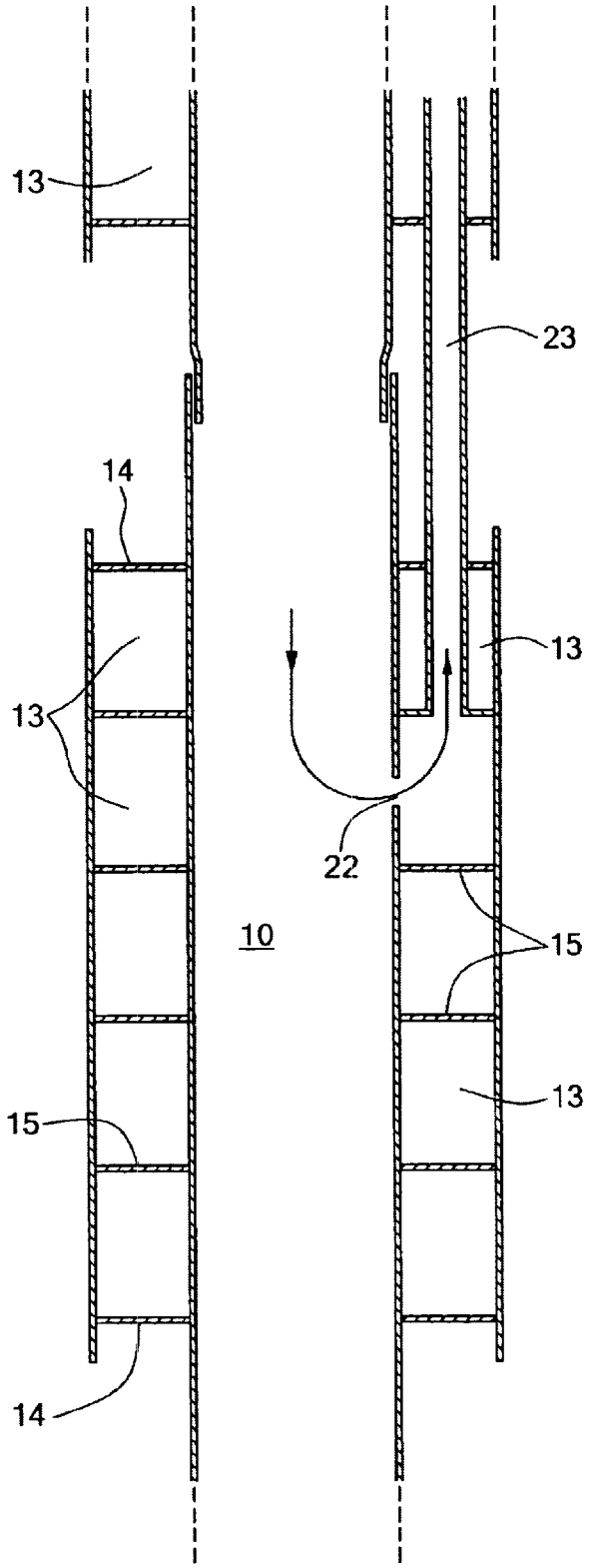
FIG. 5 shows a part of the riser pipe and the manner of sucking up mud introduced into this pipe.
Figure 6:
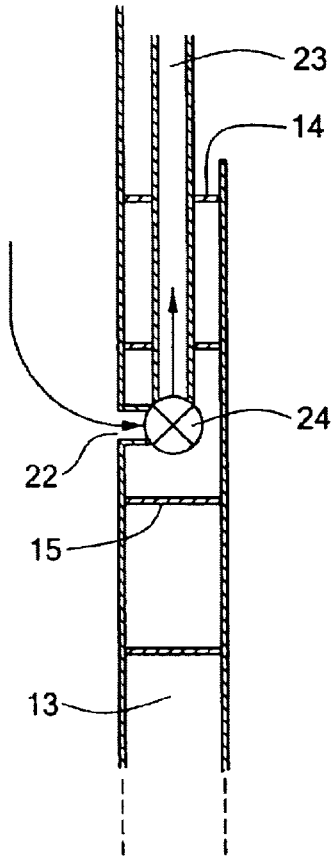
FIG. 6 shows a fragment of the riser pipe of FIG. 5, while the mud introduced into this pipe is pumped up.

As stated before, the riser pipe may be filled with mud to provide a counterpressure against leaking oil and gases from the connecting body. When the connecting body is closed again and the riser pipe must be moved up, this mud, which may perhaps be fully permeated by oil and gases, finds its way into the sea, which is an undesirable situation from an environmental standpoint. Hence, the riser pipe 10 comprises at least one opening closable by a valve 22 (see FIGS. 5 and 6). By controlling this valve 22, the interior of the riser pipe can be put into communication with a relevant pipe 23 extending upwards through a number of chambers 13. Via this pipe 23, at least part of the mud can be sucked up before the riser pipe 10 is moved up. Preferably, there are three of such pipes. The mud can be sucked up by a pump provided on the drilling vessel (FIG. 5). Because of the length of the pipe, it is better if a pump 24 is arranged within a relevant chamber (see FIG. 6). Because the power of a pump, particularly because it must be placed in a chamber of limited space, cannot be chosen too high, it proves to be a right choice if the relevant opening is provided about halfway the total length of the riser pipe.

The invention is not limited to the embodiment described herein with reference to the drawings but includes all kinds of modifications thereof, of course as far as falling within the scope of protection of the enclosed claims. Thus, for instance, it is possible that the riser pipe construction parts lowered less deeply into the sea are of less heavy design than the parts reaching to near the sea floor. The pressure applied in the chambers may be selected in dependence on the selection of the steel type and the thickness thereof, as well as on the relevant depth of the sea.

It shall be clear that the riser pipe construction can also be built up as a combination of both conventional modules and modules comprising tubular chambers according to the invention, e.g. a riser pipe construction comprising an upper or intermediate portion of conventional modules and the remaining portion comprising modules having tubular chambers.

What is claimed is:

1. A riser pipe construction for a drilling connection from a drilling vessel to a valve previously provided on a sea floor, comprising:

a plurality of riser pipe modules coupled together forming a riser pipe through which drilling means can be passed by means of which an oil well can be drilled;

a plurality of pressure pipe modules coupled together forming a pressure pipe extending parallel to the riser pipe to operate the valve, and a plurality of floating elements each formed by at least one steel tubular chamber closed so as to be gastight, each of the floating elements disposed around a portion of a corresponding riser pipe module and a portion of a corresponding pressure pipe module, the portion of the steel tubular chamber being firmly and permanently connected to the corresponding riser pipe module by means of plates, wherein the at least one steel tubular chamber is filled with a gaseous medium having an elevated pressure.

2. The riser pipe construction according to claim 1, characterized in that the at least one steel tubular chamber is filled with air, in particular up to a pressure in the order of 100 bar.

3. The riser pipe construction according to claim 1, characterized in that each of the tubular chambers comprises partitions disposed substantially radially with respect to the riser pipe module.

4. The riser pipe construction according to claim 1 characterized in that the riser pipe comprises at least one opening closable by at least one second valve, the at least opening can be put into communication with a relevant pipe extending upwards through the floating elements.

5. The riser pipe construction according to claim 4, characterized in that the communication to the relevant pipe includes a pump placed within the tubular chamber.

6. The riser pipe construction according to claim 4, characterized in that the at least one opening is provided about halfway the total length of the riser pipe.

7. The riser pipe construction according to claim 1, characterized in that the modules of riser pipe and pressure pipes are provided with at least one end thereof with a flange part and at another end thereof with a connecting part, and the modules can be coupled together through said flange part, while the tubular chamber extends along each of the modules in the longitudinal direction from near the flange part, on the one end, to near the relevant connecting part on the other end.

8. The riser pipe construction according to claim 7, characterized in that a covering element is provided between the tubular chambers around two of the modules coupled together.

9. The riser pipe construction according to claim 8, characterized in that the tubular chambers have a cylindrical shape and a diameter, while the covering element also has a cylindrical shape and approximately the same diameter as the tubular chambers.

10. The riser pipe construction according to claim 1, characterized in that the tubular chambers are manufactured from steel having a plate thickness of the order of from 10 to 25 mm, and a yield strength of at least 800 $NM/mm^2$.

11. The riser pipe construction according to claim 10, characterized in that the tubular chambers are manufactured from steel having a plate thickness of about 18 mm, and a yield strength of about 1100 $N/mm^2$.

12. A module for a riser pipe construction comprising a riser pipe module, a pressure pipe module extending substantially parallel to the riser pipe module, and a floating element in the form of a steel tubular chamber closed so as to be gastight, the floating element disposed around a portion of the riser pipe module, the steel tubular chamber being firmly and permanently connected to the corresponding riser pipe module by means of plates, the tubular chamber being filled under elevated pressure with a gaseous medium.

13. The module according to claim 11, wherein the tubular chamber comprises partitions disposed substantially radially with respect to the pipe module.

* * * * *

UNITED STATES PATENT AND TRADEMARK OFFICE

CERTIFICATE OF CORRECTION

PATENT NO. : 6,637,513 B1
DATED : October 28, 2003
INVENTOR(S) : Hans van der Poel It is certified that error appears in the above-identified patent and that said Letters Patent is hereby corrected as shown below:

Title page,
Item [73], Assignee, "Zwigndrecht" should read -- Zwijndrecht --; and Column 8,
Line 32, "11" should read -- 12 --.

Signed and Sealed this

Fourth Day of January, 2005

JON W. DUDAS
*Director of the United States Patent and Trademark Office*